US005948311A

United States Patent [19]

Beecroft et al.

[11] Patent Number: 5,948,311

[45] Date of Patent: Sep. 7, 1999

[54] MICROWAVE PLANT PRESS

[76] Inventors: William Robert Beecroft; Jennifer Leslie Beecroft, both of P.O. Box 1837, Caboolture, Queensland 4510, Australia

[21] Appl. No.: 08/909,553

[22] Filed: Aug. 12, 1997

[51] Int. Cl.[6] ..... H05B 6/64

[52] U.S. Cl. ..... 219/762; 156/580

[58] Field of Search ..... 219/735, 762, 219/757; 34/259, 263, 265; 156/580

[56] References Cited

U.S. PATENT DOCUMENTS

| | | | |
|---|---|---|---|
| 3,852,891 | 12/1974 | Stephan et al. | 34/95 |
| 5,191,721 | 3/1993 | Incorvia et al. | 34/1 P |
| 5,230,767 | 7/1993 | Taylor et al. | 156/580 |
| 5,675,909 | 10/1997 | Pare et al. | 34/265 |
| 5,732,476 | 3/1998 | Pare et al. | 34/265 |

FOREIGN PATENT DOCUMENTS

| | | |
|---|---|---|
| 103396 A2 | 3/1984 | European Pat. Off. . |
| 2553873 | 4/1985 | France . |
| 3220619 | 12/1983 | Germany . |
| 3443165 | 11/1986 | Germany . |
| 05-94870 | 4/1993 | Japan . |
| 2222095 | 2/1990 | United Kingdom . |

*Primary Examiner*—Teresa Walberg
*Assistant Examiner*—Jeffrey Pwu
*Attorney, Agent, or Firm*—Ian F. Burns

[57] ABSTRACT

A plant drying press for use in a microwave oven wherein plant material is held between absorbent sheets (14) backed by vapour permeable pads (12) with the assembly clamped between plattens (11) held by clips (15). The permeable pads (12) are ideally resilient. The plattens (11) are plate-like, ideally with ribs (17–20) and perforated (13, 21). The platens (11), pads (12) and sheets (14) are ideally microwave transparent.

23 Claims, 3 Drawing Sheets

MICROWAVE PLANT PRESS

FIELD OF THE INVENTION

This invention relates to developments in what are commonly referred to as flower presses by which to dry plants and parts thereof and particularly to a press of this general character which effects drying of plant material by means of electro-magnetic energy such as microwaves.

BACKGROUND OF THE INVENTION

Plant material is commonly preserved by drying. Plant material can be dried for decorative and craft uses in the flat, between surfaces holding or pressing the material therebetween. Flowers, petals, leaves and other plant parts are typically pressed between absorbent layers of material by means of specially devised presses or simply under a convenient weight. Drying of this kind has been effected between the pages of books with others on top to effect pressing. The plant parts undergo a drying process over a period of time which can extend from days to weeks and even months depending on the nature of the material being dried and the characteristics of the absorbent layers being used.

The prior art includes apparatus that utilises microwave energy in a continuous press to effect curing of curable assemblies, for example, EP 0103396.

The prior art includes many techniques by which a wide variety of materials can be dried. Patent specification GB 2222095 (Pierson) sets out a drying technique utilising microwaves to effect heating of filter cake with a vacuum utilised to extract evaporated liquid.

The foregoing are not applicable to delicate materials such as flowers and other parts of plants.

Microwave energy has been proposed as a means of effecting drying of plant material in FR 2553873. In this process the plant material is placed between two pieces of corrugated cardboard, compressed and then placed in a microwave oven. Heating is for one to two minutes at a time, with rest periods between to enable cooling if the one to two minute heating period is insufficient. The need to cool between periods of heating slows the process down.

OBJECT OF THE INVENTION

It is an object of the invention to provide a press for drying plant material, either whole plants or parts of plants, by a means which achieves a more convenient drying in an accelerated drying process. Other objects and various advantages will hereinafter become apparent.

NATURE OF THE INVENTION

The invention achieves its object in the provision of a press for drying parts of plants, plant parts, flowers and the like comprising:

- at least two support elements between which items to be dried are sandwiched, in use; and
- support means by which to hold the support elements together;
- characterised in that
  - said support elements and said support means being microwave permeable, or substantially transparent to microwaves, to expose, in use, said items to microwave heating; and
  - said support elements are substantially permeable to vapour caused by the heating.

In the following the invention is referred to as a press. In the context of the invention, a press is a means of primarily drying items loaded therein with sufficient support applied thereto to maintain the integrity of the item being dried. In practice, a degree of pressure may be applied thereto to squeeze down the thickness dimension of the item dried to effect production of a relatively flat dried product. Thus the primary function of the so-called press is a drying function. Actual flattening of the product is usually desired but not an essential end result. The invention includes presses where drying is achieved without regard to dimensional variation enabling drying as much without as with dimension reduction by suitable choice of the resilient quality of the pad material employed.

The support elements or press pads are primarily permeable to vapours to release vaporised fluids released during heating. The pads may have a degree of resilience chosen to suit particular items being dried and the nature of the desired end result. In practice the pads may ideally be woollen felt with a thickness selected to suit the desired end result, the thickness determining to a degree the workable range over which resilience is available to enable embedding of items to be dried therein.

BRIEF DESCRIPTION OF THE DRAWINGS

The invention will now be described with reference to preferred embodiments which are illustrated in the accompanying drawings in which.

PREFERRED EMBODIMENTS

Figure 1:
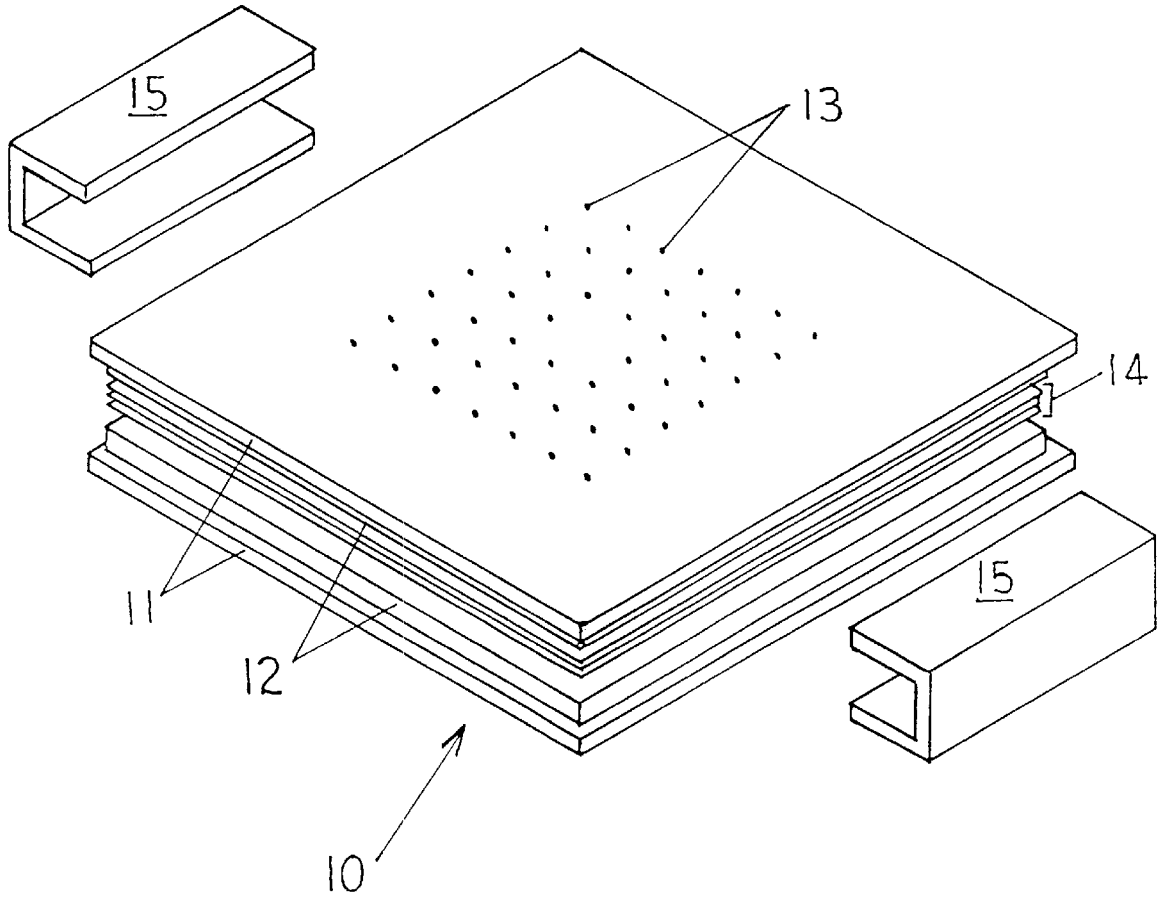
FIG. 1 is an isometric showing, in partly exploded form, the elements of a press in accordance with an embodiment of the invention.

The press typically consists of two platens 11 made of a material which is permeable or transparent to a useful degree to microwaves (hereinafter referred to as substantially transparent) so as to effect heating of the plant material without degradation of the part, such as is achieved by certain types of plastic. The press plattens may be perforated to permit passage of vapours and ideally they are provided with small holes 13 for venting of vapours generated in the drying process. It will be clear that other forms of vent such as slots might be used. The area and shape of the platens may be varied to suit any desired purpose (size of plant material to be accommodated, oven size, etc), and the number and spacing of the perforations is immaterial, providing that adequate ventilation is achieved. Each platen adjoins or can be faced with a pad 12 of a soft and/or resilient permeable or generally vapour transparent material, such as foam plastic, felt, blanket material or the like, so that vapours may escape the plant material. The pads 12 may be compressed, in use, to exert a degree of pressure on the items being dried. Their thickness is typically about 5 mm. This is thick enough to provide sufficient resilience to hold and support the most common forms of plant material. Pressure maintains the traditional flat configuration during the drying process. The resilient properties of the pads 12 squeezes thick specimens during the drying process. For example, a camellia may be 50 mm at its thickest cross section prior to drying and 1 to 2 mm thick afterwards. The reduction in thickness is only produced with pressure. Too thin a pad and there is too little resilience. In traditional flower pressing, this was achieved by using considerable pressure and prolonged natural drying, whereas with the present device it is achieved with a combination of mild pressure and accelerated drying.

To operate the device, the plant parts are placed between sheets of suitable material such as permeable and/or absorbent material (hereinafter more simply referred to as absorbent material for convenience) such as linen, blotting paper, or the like. More than one layer of plant parts may be dried at one time, providing each layer is separated by a sheet of permeable and/or absorbent material. It is desirable that the items for drying are reasonably thin and able to be flattened as is known in the art. Thicker portions dry more slowly. Where there is a relative difference in thicknesses of parts of the plant, or separate specimens being dried, the thinner portions may burn before the thicker portions dry. Reduction of thicker portions results in more uniform drying and a more uniformly thin final result as is known in the traditional process. For this purpose, it may be necessary to split or slice thicker parts such as buds, flower styles or receptacles, and like parts. When the plant parts are enveloped between the absorbent sheets, the assembly 14 of absorbent sheets and plant parts is placed between the pads 12 which are, in turn, placed between the platens 11. In the example shown on the drawing, the assembly 14, platens 11, and pads 12 are shown in their correct proximity prior to slipping the clips 15 over the outer faces of the platens to clamp them together, and so retain and flatten the parts of plants within the device. Clamps, screws, weights or other methods may be used, acting on the plattens or thereagainst instead of the clips 15 shown in this example, to provide the required function of clamping. The press is then placed in a microwave oven and irradiated with microwave energy for a short period, the actual time depending on the microwave power, and the nature of the plant parts. The press may then be removed from the microwave oven, dismantled and the plant parts inspected. If the plant parts are not thoroughly dried, the process may be repeated until a satisfactory result is obtained.

Figure 2:
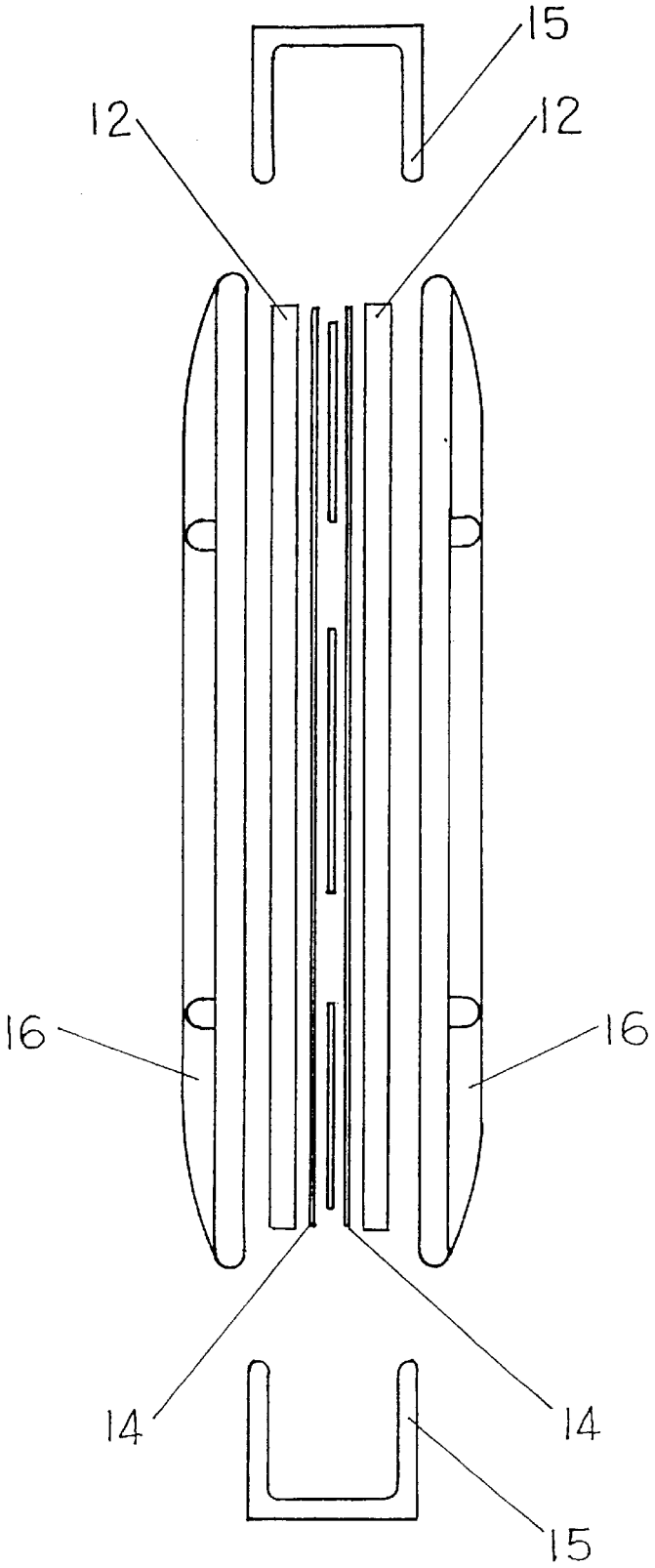
FIGS. 2 and 3 are an exploded elevation and a plan view of a press in accordance with the present invention.

In FIG. 2 is seen an exploded side elevation of a press with opposed platens 16 (seen in plan view in FIG. 3) with, as before, pads 12 and layers 14 therebetween. The assembly is held by clips 15 as before.

Figure 3:
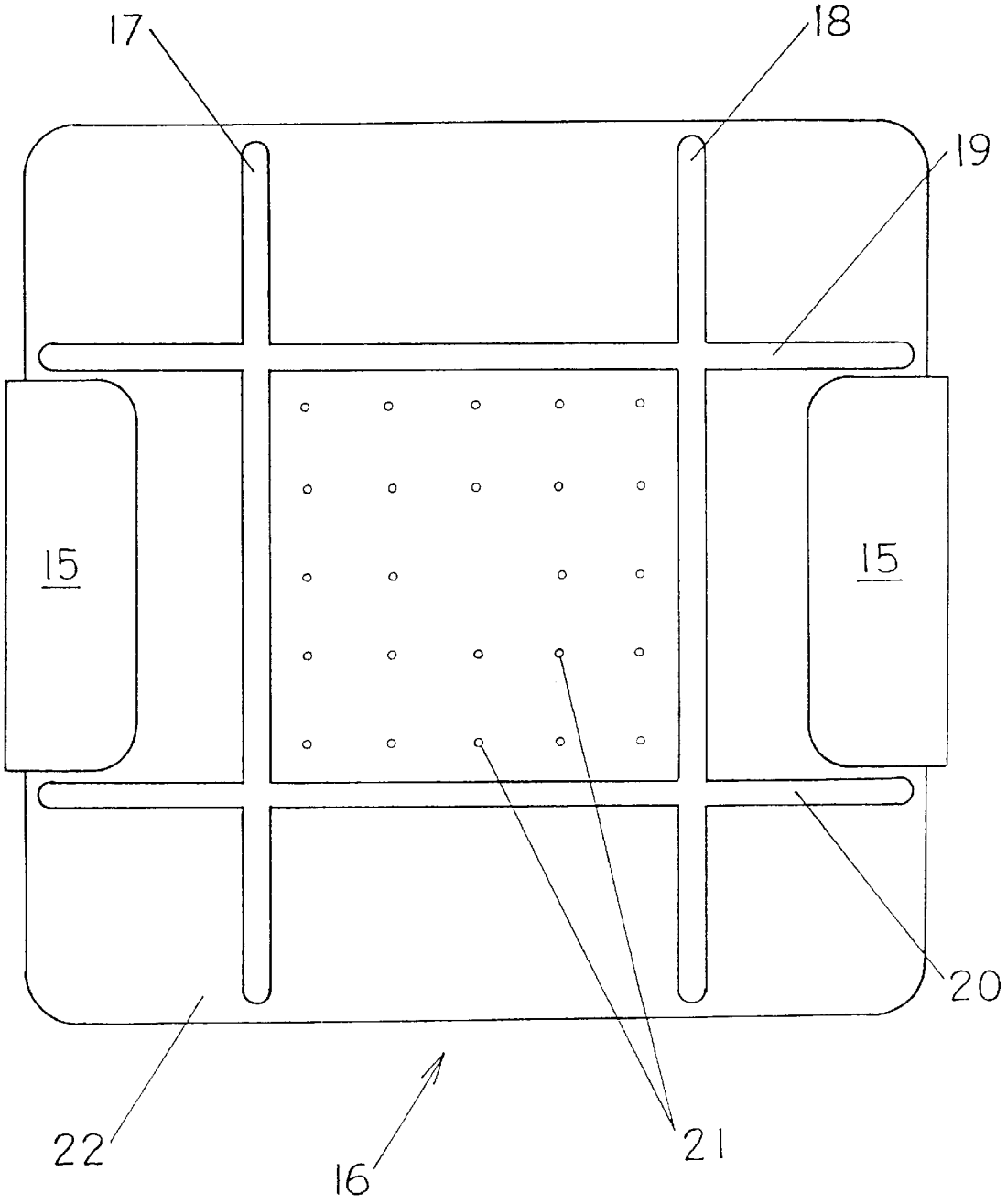

In FIG. 3 is a plan view of a press as in FIG. 2 showing the external features of platen 16 engaged by clips 15. Platen 16 is a body of plate material 22 with upstanding ribs 17 to 20 crossed thereover as shown. A pattern of perforations 21 is provided as before. The introduction of ribs enables the strength required in a platen with a reduction of thickness in the plate such that the perforations become more effective at exhausting vapours.

The above described apparatus and its method of use works well in normal domestic microwave ovens working in the 2500 MHZ frequency range. Clearly heating might be effected at other frequencies but typically use will be by users utilising the present apparatus in their domestic ovens. By using the press in the manner described, parts of plants may be dried and pressed in a much shorter time and the dried parts retain a significantly higher amount of colour than is the case using traditional methods. In conventional methods of pressing flowers, the drying process takes place over an extended time by gradual absorption or evaporation. When subjected to microwaves, the fluids in the plant are boiled off rapidly, and this process is enhanced when conditions enable the vapours to be rapidly conducted away from the plant.

The selection of materials for components of the press can be important for this process, as noted in the following.

The press components should be made of materials which are substantially permeable to and preferably transparent to microwaves.

The pads 12 are preferably soft, permeable, and resilient (to a degree), the objectives being:

(a) to absorb or draw off the vapours emitted from the plant;

(b) to allow the vapours to be conducted away from the plant;

(c) to retain the plant in a flat configuration during the drying process;

(d) to enable a degree of perpendicular (to the plattens) pressure to be applied to plant during the drying process.

A number of materials have been tested for the above pads, including polyester felt, polystyrene foam, rubber foam, blanket material and woollen felt. Woollen felt has so far proven to give the most superior results.

The platens 11 are perforated to assist in exhausting vapours which are absorbed by the pad 12 during the drying process. This has been found to benefit the drying process, probably because it reduces the build-up of vapours in the pads 12. The primary purpose of the platens is to retain the pads 2 and assembly 4 in the desired configuration. This need not necessarily mean a flat configuration, it could also be curved in a single or compound plane.

The permeable and/or absorbent material used in the assembly 14 is mainly used to protect the pads 12 from becoming stained by plant fluids. The texture of this material is important as it can influence the texture of the dried plant component. In practice, various types of paper products and woven materials have been tried, and the material which has given the best results is closely woven cotton fabric. The sheets 14 need to be permeable so that vapour passes through.

The clips 15 must be made of a material which is transparent to microwaves. Other methods may be used to provide the clamping function.

We claim:

1. A press for drying plants, plant parts, flowers and the like utilizing microwave energy comprising:

at least two support elements between which items to be dried are sandwiched, in use; and support means by which to hold the support elements together;

characterised in that said support elements and said support means being microwave permeable, or substantially transparent to microwaves, to expose, in use, said items to microwave heating; and said support elements are substantially permeable to vapour caused by the heating.

2. A press as claimed in claim 1 wherein:

the support elements are substantially resilient.

3. A press as claimed in claim 1 wherein:

the support means comprises a pair of platens which are perforated to enable the passage of vapour therethrough and are interacted or fitted with inter-engagement means by which the assembly is held together for loading, in use, into a microwave oven.

4. A press as claimed in claim 3 wherein:

the platens comprise plate material with the perforations as an array of holes therethrough.

5. A press as claimed in either one of claims 3 or 4 wherein:

the platens are formed with planar outer surfaces at opposed edges and the inter-engagement means are generally U-shaped clips engaged thereover with the assembly therebetween.

6. A press as claimed in claim 1 wherein:

the support elements are faced with absorbent layers located between said support elements and the said items.

7. A press as claimed in claim 6 wherein:

the absorbent layers are woven material.

8. A press as claimed in any one of claims 3 to 4 wherein:

the platens are moulded in a microwave transparent plastic or like type material in thin plate form with upstanding strengthening ribs thereacross on an outer surface.

9. A press as claimed in either one of claims 6 to 7 wherein:

the absorbent layers are fibre based sheets such as paper or woven material, preferably closely woven cotton.

10. A press as claimed in either one of claims 1 or 2 wherein:

the support elements are pads formed of a material selected from polyester felt, polystyrene foam, rubber foam, blanket material, woollen felt and the like.

11. A press as claimed in claim 10 wherein:

the pads are formed by woollen felt.

12. A microwaveable plant drying press for drying plant material utilizing microwave energy characterised in that said press comprises:

porous absorbent sheet material for sandwiching plant material therebetween;

resilient vapour permeable pads for supporting said porous absorbent sheet material and sandwiched plant material therebetween.

13. A microwavable plant drying press as claimed in claim 12 wherein:

the resilient vapour permeable pads are backed by perforated platens which are locked together, in use, to maintain the assembly of plant, sheets and pads during microwave heating.

14. A microwavable plant drying press as claimed in claim 13 wherein:

the sheets are woven cotton and the pads are woollen felt.

15. A system for drying plant material, such as flowers and the like, using microwave energy:

(A) a plant press, said plant press comprising:

(a) at least two platens, said platens being adapted to be at least partially vapor permeable and substantially microwave transparent and to support plant material when the plant material is placed between said platens;

(b) a clamping device, said clamping device being adapted to be substantially microwave transparent and to provide a clamping force on said platens when plant material is placed between said platens; and (B) a microwave energy source, said microwave energy source being adapted to direct microwave energy onto said plant press, whereby plant material in said plant press is subjected to microwave energy and heated thereby causing drying in the plant material.

16. The system of claim 15 wherein at least one of said platens comprise at least one hole, said hole being adapted to vent vapours.

17. The system of claim 15 wherein at least one of said platens comprise at least one rib, said rib being adapted to strengthen said platen.

18. The system of claim 15 wherein said plant press further comprises at least one pad, said pad being adapted to be placed between the plant material and at least one of said platens.

19. The system of claim 15 wherein said plant press further comprises an absorbent sheet, said absorbent sheet being adapted to be placed between the plant material and at least one of said platens and to absorb moisture released by the plant material.

20. The system of claim 15 wherein said microwave energy source comprises a microwave oven.

21. A method of drying plant material, the method comprising the following steps:

(A) providing a plant press, the plant press comprising:

(a) at least two platens, the platens being adapted to be at least partially vapor permeable and substantially microwave transparent and to support plant material when the plant material is placed between said platens;

(b) a clamping device, the clamping device being adapted to be substantially microwave transparent and to provide a clamping force on said platens when plant material is placed between said platens;

(B) placing plant material between the platens;

(C) engaging the clamping device with the platens when the plant material is in between the platens; and (D) exposing the plant press with the plant material to microwave energy, wherein the plant material is heated by the microwave energy.

22. The method of claim 21 further comprising the step of placing a pad between the plant material and the platens.

23. The method of claim 21 further comprising the step of placing an absorbent sheet between the plant material and the platens.

* * * * *